US011078900B2

(12) United States Patent
Takahashi

(10) Patent No.: US 11,078,900 B2
(45) Date of Patent: Aug. 3, 2021

(54) CRYOPUMP, CRYOPUMP CONTROLLER, AND CRYOPUMP CONTROL METHOD

(71) Applicant: SUMITOMO HEAVY INDUSTRIES, LTD., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 122 days.

(21) Appl. No.: 15/465,283

(22) Filed: Mar. 21, 2017

(65) Prior Publication Data

US 2017/0276128 A1 Sep. 28, 2017

(30) Foreign Application Priority Data

Mar. 22, 2016 (JP) ..... JP2016-057050

(51) Int. Cl.
*F04B 49/06* (2006.01)
*F04B 37/08* (2006.01)

(52) U.S. Cl.
CPC ..... *F04B 49/06* (2013.01); *F04B 37/08* (2013.01); *F04B 37/085* (2013.01)

(58) Field of Classification Search
CPC ..... F04B 37/08; F04B 37/085; F25D 19/006; H01F 6/04; F25B 9/10
See application file for complete search history.

(56) References Cited

U.S. PATENT DOCUMENTS 8,302,409 B2 * 11/2012 Fukuda ..... F04B 37/085 417/901
8,375,729 B2 * 2/2013 Schwartz ..... F25B 9/145 62/6
9,068,564 B2 6/2015 Kimura
9,415,325 B2 8/2016 Fukuda
2007/0107448 A1 * 5/2007 Dresens ..... B01D 8/00 62/149

(Continued)

FOREIGN PATENT DOCUMENTS

JP 2000-249057 A 9/2000
JP 2004-027866 A 1/2004

(Continued)

*Primary Examiner* — Frantz F Jules
*Assistant Examiner* — Webeshet Mengesha
(74) *Attorney, Agent, or Firm* — Michael Best & Friedrich LLP

(57) ABSTRACT

A cryopump includes: a first-stage target temperature selection unit which includes a normal target temperature for a normal mode of maintaining each of a first stage cryopanel and a second stage cryopanel at an extremely low temperature region, and a cool-down target temperature lower than the normal target temperature, for a cool-down mode of cooling each of the first stage cryopanel and the second stage cryopanel from room temperature to the extremely low temperature region, and selects the normal target temperature as a first-stage target temperature in a case where a current operation mode is the normal mode, and at least temporarily selects the cool-down target temperature as the first-stage target temperature in a case where the current operation mode is the cool-down mode; and a first-stage temperature control unit which controls a first-stage cryopanel temperature according to the selected first-stage target temperature.

7 Claims, 7 Drawing Sheets

(56) References Cited

U.S. PATENT DOCUMENTS

| | | | | |
|---|---|---|---|---|
| 2007/0256429 | A1* | 11/2007 | Fukuda | F04B 37/08 62/55.5 |
| 2011/0265495 | A1* | 11/2011 | Oikawa | F04B 37/08 62/55.5 |
| 2013/0160468 | A1* | 6/2013 | Kimura | F25B 49/022 62/6 |
| 2014/0230461 | A1* | 8/2014 | Takahashi | F04B 37/08 62/55.5 |
| 2014/0260339 | A1* | 9/2014 | Matsui | F04B 37/08 62/55.5 |
| 2015/0196221 | A1* | 7/2015 | Garside | F25B 9/14 600/410 |

FOREIGN PATENT DOCUMENTS

| | | | |
|---|---|---|---|
| JP | 2007-298008 | A | 11/2007 |
| JP | 4150745 | B2 | 9/2008 |
| JP | 4912438 | B2 | 4/2012 |
| JP | 2013-170568 | A | 9/2013 |

* cited by examiner

| OPERATION MODE | FIRST STAGE TARGET TEMPERATURE |
|---|---|
| NORMAL MODE | T1c1=80K |
| COOL-DOWN MODE | T1c2=70K |

116

| OPERATION MODE | | FIRST STAGE TARGET TEMPERATURE |
|---|---|---|
| NORMAL MODE | | T1c1=80K |
| COOL-DOWN MODE | FIRST PHASE | T1c21=60K |
| | SECOND PHASE | T1c22=70K |

116

CRYOPUMP, CRYOPUMP CONTROLLER, AND CRYOPUMP CONTROL METHOD

RELATED APPLICATIONS

Priority is claimed to Japanese Patent Application No. 2016-057050, filed Mar. 22, 2016, the entire content of which is incorporated herein by reference.

BACKGROUND

Technical Field

Certain embodiments of the present invention relate to a cryopump, a cryopump controller, and a cryopump control method.

Description of Related Art

When a new cryopump has been installed at a job site, the cryopump is cooled from room temperature to an extremely low temperature and a vacuum pumping operation is then started. Further, as is known, the cryopump is a gas storage type vacuum pump, and therefore, regeneration is performed at a certain frequency in order to discharge stored gas to the outside. The regeneration processing generally includes a temperature raising step, a discharge step, and a cooling step. If the cooling step is ended, the vacuumpumping operation of the cryopump is restarted. Cooling of the cryopump as preparation for such a vacuum pumping operation is sometimes called cool-down.

SUMMARY

According to an embodiment of the present invention, there is provided a cryopump including: a first stage cryopanel; a second stage cryopanel; a first stage target temperature selection unit which is provided with a normal target temperature for a normal mode of maintaining each of the first stage cryopanel and the second stage cryopanel at an extremely low temperature region, and a cool-down target temperature for a cool-down mode of cooling each of the first stage cryopanel and the second stage cryopanel from room temperature to the extremely low temperature region, the cool-down target temperature being lower than the normal target temperature, and selects the normal target temperature as a first stage target temperature in a case where a current operation mode is the normal mode, and at least temporarily selects the cool-down target temperature as the first stage target temperature in a case where the current operation mode is the cool-down mode; and a first stage temperature control unit which controls a first stage cryopanel temperature according to the selected first stage target temperature.

According to another embodiment of the present invention, there is provided a cryopump controller including: a first stage target temperature selection unit which is provided with a normal target temperature for a normal mode of maintaining each of a first stage cryopanel and a second stage cryopanel at an extremely low temperature region, and a cool-down target temperature for a cool-down mode of cooling each of the first stage cryopanel and the second stage cryopanel from room temperature to the extremely low temperature region, the cool-down target temperature being lower than the normal target temperature, and selects the normal target temperature as a first stage target temperature in a case where a current operation mode is the normal mode, and at least temporarily selects the cool-down target temperature as the first stage target temperature in a case where the current operation mode is the cool-down mode; and a first stage temperature control unit which controls a first stage cryopanel temperature according to the selected first stage target temperature.

According to still another embodiment of the present invention, there is provided a cryopump control method including: selecting a first stage target temperature according to a current operation mode; and controlling a first stage cryopanel temperature according to the selected first stage target temperature. A cool-down target temperature fora cool-down mode of cooling each of a first stage cryopanel and a second stage cryopanel from room temperature to an extremely low temperature region is lower than a normal target temperature for a normal mode of maintaining each of the first stage cryopanel and the second stage cryopanel at the extremely low temperature region, and the cool-down target temperature is at least temporarily used in a case where the current operation mode is the cool-down mode.

DETAILED DESCRIPTION

Figure 1:
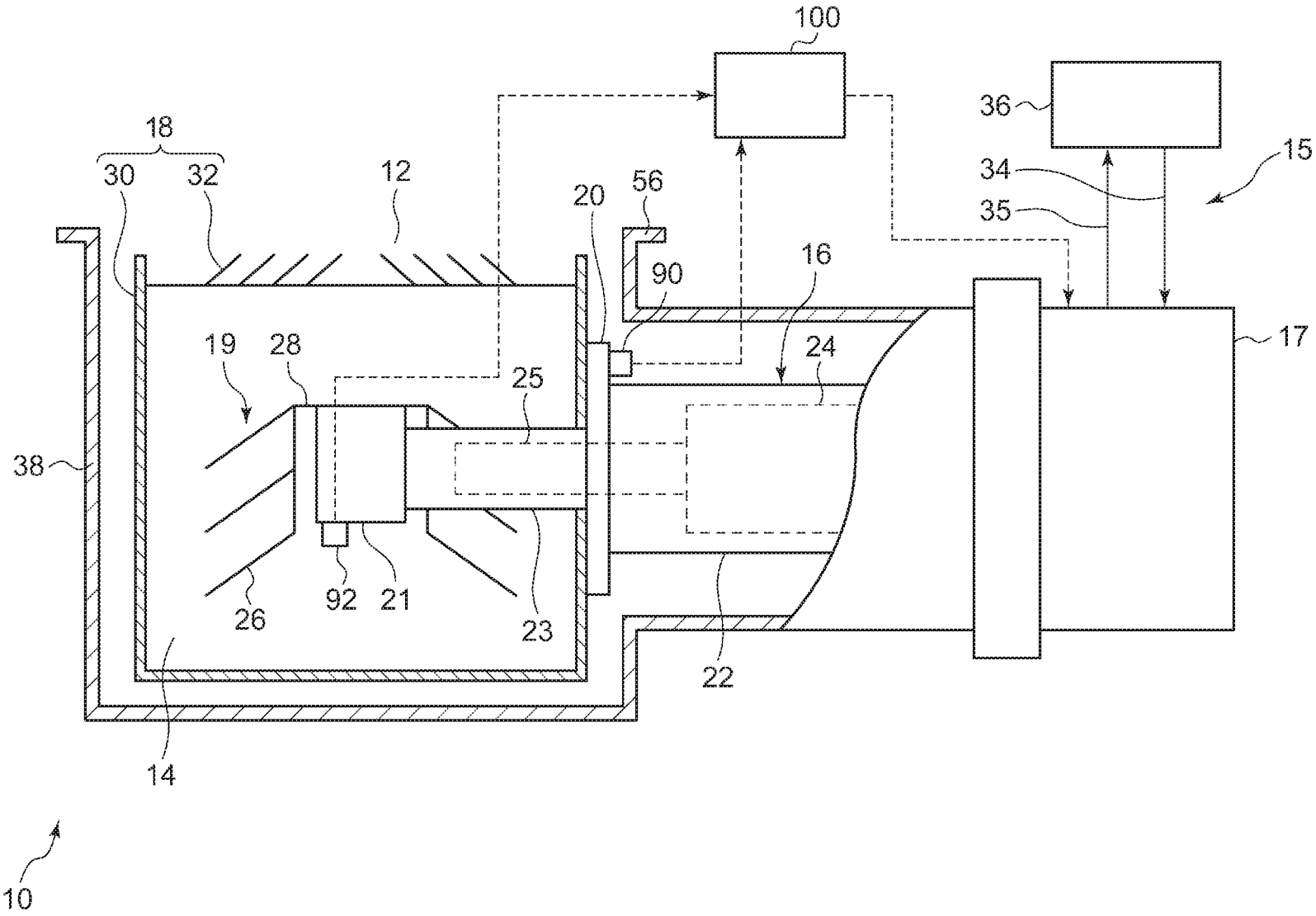
FIG. 1 schematically shows a cryopump according to an embodiment.

A cryopump is one of the main uses of a cryocooler. However, it is different from other uses in that a relatively large temperature difference is needed between a high temperature stage and a low temperature stage of the cryocooler. However, it is not easy to produce such a temperature difference in a short time when cooling the cryopump. For example, if the low temperature stage has not yet reached a target temperature when the high temperature stage has reached a target cooling temperature, the low temperature stage must continue to be further cooled while maintaining the high temperature stage at the target temperature. A certain amount of time is required for such temperature adjustment at the final stage of cool-down. In particular, in a case where a large temperature difference is needed between the high temperature stage and the low temperature stage, a time which is required for the temperature adjustment becomes longer. The cool-down causes a down-time of the cryopump, and therefore, it is desirable to perform it in a short time.

It is desirable to shorten a cooling time of a cryopump.

Arbitrary combinations of the above constituent elements, or mutual substitutions of constituent elements or expressions of the present invention between apparatuses, methods, systems, computer programs, recording mediums with computer programs stored therein, or the like are also effective as aspects of the present invention.

According to the present invention, it is possible to shorten a cooling time of a cryopump.

Hereinafter, a mode for carrying out the present invention will be described in detail with reference to the drawings. In the description, the same elements are denoted by the same reference numerals and overlapping description is omitted as appropriate. Further, the configurations which are described below are exemplification and do not limit the scope of the present invention.

FIG. 1 is a diagram schematically showing a cryopump 10 according to an embodiment. The cryopump 10 is mounted in a vacuum chamber of, for example, an ion implantation apparatus, a sputtering apparatus, or the like and used in order to increase the degree of vacuum of the inside of the vacuum chamber to a level which is required for a desired process.

The cryopump 10 has an intake port 12 for receiving gas. The intake port 12 is an inlet to an internal space 14 of the cryopump 10. Gas to be exhausted enters the internal space 14 of the cryopump 10 from the vacuum chamber with the cryopump 10 mounted therein through the intake port 12.

In the following, in order to clearly show the positional relationship between constituent elements of the cryopump 10, the terms "axial direction" and "radial direction" are often used. The axial direction represents a direction passing through the intake port 12, and the radial direction represents a direction along the intake port 12. For convenience, with respect to the axial direction, the side relatively close to the intake port 12 is often referred to as an "upper side" and the side relatively far from the intake port 12 is often referred to as a "lower side". That is, the side relatively far from the bottom of the cryopump 10 is often referred to as an "upper side" and the side relatively close to the bottom of the cryopump 10 is often referred to as a "lower side". With respect to the radial direction, the side close to the center of the intake port 12 is often referred to as an "inner side" and the side close to a peripheral edge of the intake port 12 is often referred to as an "outer side". Such expressions are not related to the disposition when the cryopump 10 has been mounted in the vacuum chamber. For example, the cryopump 10 may be mounted in the vacuum chamber with the intake port 12 facing downward in a vertical direction.

The cryopump 10 is provided with a cooling system 15, a first stage cryopanel 18, and a second stage cryopanel 19. The cooling system 15 is configured so as to cool the first stage cryopanel 18 and the second stage cryopanel 19. The cooling system 15 is provided with a cryocooler 16 and a compressor 36.

The cryocooler 16 is a cryocooler such as a Gifford McMahon type cryocooler (a so-called GM cryocooler), for example. The cryocooler 16 is a two-stage type cryocooler which is provided with a first cooling stage 20, a second cooling stage 21, a first cylinder 22, a second cylinder 23, a first displacer 24, and a second displacer 25. Accordingly, a high-temperature stage of the cryocooler 16 is provided with the first cooling stage 20, the first cylinder 22, and the first displacer 24. A low-temperature stage of the cryocooler 16 is provided with the second cooling stage 21, the second cylinder 23, and the second displacer 25. Accordingly, in the following, the first cooling stage 20 and the second cooling stage 21 can also be respectively referred to as a low-temperature end of the high-temperature stage and a low-temperature end of the low-temperature stage.

The first cylinder 22 and the second cylinder 23 are connected in series. The first cooling stage 20 is installed at a joined portion between the first cylinder 22 and the second cylinder 23. The second cylinder 23 connects the first cooling stage 20 and the second cooling stage 21. The second cooling stage 21 is installed at the terminus of the second cylinder 23. The first displacer 24 and the second displacer 25 are respectively disposed inside of the first cylinder 22 and the second cylinder 23 so as to be movable in a longitudinal direction (a right-and-left direction in FIG. 1) of the cryocooler 16. The first displacer 24 and the second displacer 25 are connected to each other so as to be integrally movable. A first regenerator and a second regenerator (not shown) are respectively incorporated into the first displacer 24 and the second displacer 25.

A drive mechanism 17 is provided at a room-temperature part of the cryocooler 16. The drive mechanism 17 is connected to the first displacer 24 and the second displacer 25 such that the first displacer 24 and the second displacer 25 can respectively reciprocate inside of the first cylinder 22 and the second cylinder 23. Further, the drive mechanism 17 includes a flow path switching mechanism for switching a flow path of working gas so as to periodically repeat the suction and discharge of the working gas. The flow path switching mechanism includes, for example, a valve part and a drive part for driving the valve part. The valve part includes, for example, a rotary valve, and the drive part includes a motor for rotating the rotary valve. The motor may be, for example, an AC motor or a DC motor. Further, the flow path switching mechanism may be a direct-acting type mechanism which is driven by a linear motor.

The cryocooler 16 is connected to the compressor 36 through a high-pressure conduit 34 and a low-pressure conduit 35. The cryocooler 16 generates cold in the first cooling stage 20 and the second cooling stage 21 by expanding high-pressure working gas (for example, helium) supplied from the compressor 36 inside thereof. The compressor 36 recovers the working gas expanded in the cryocooler 16, pressurizes it again, and then supplies it to the cryocooler 16.

Specifically, first, the drive mechanism 17 makes the high-pressure conduit 34 and an internal space of the cryocooler 16 communication with each other. The high-pressure working gas is supplied from the compressor 36 to the cryocooler 16 through the high-pressure conduit 34. If the internal space of the cryocooler 16 is filled with the high-pressure working gas, the drive mechanism 17 switches the flow path so as to make the internal space of the cryocooler 16 communicate with the low-pressure conduit 35. In this way, the working gas expands. The expanded working gas is recovered to the compressor 36. The first displacer 24 and the second displacer 25 respectively reciprocate inside of the first cylinder 22 and the second cylinder 23 in synchronism with the supply and discharge of the working gas. Such a thermal cycle is repeated, whereby the cryocooler 16 generates cold in the first cooling stage 20 and the second cooling stage 21.

The cryocooler 16 is configured so as to cool the first cooling stage 20 to a first temperature level and cool the second cooling stage 21 to a second temperature level. The second temperature level is lower than the first temperature level. For example, the first cooling stage 20 is cooled to a temperature in a range of about 60 K to 130 K, or about 65 K to 120 K, or preferably, 80 K to 100 K, and the second cooling stage 21 is cooled to a temperature in a range of about 10 K to 20 K.

The cryocooler 16 is configured so as to make the working gas flow to the low-temperature stage through the high-temperature stage. That is, the working gas flowing in from the compressor 36 flows from the first cylinder 22 to the second cylinder 23. At this time, the working gas is cooled to the temperature of the first cooling stage 20 by the first displacer 24 and the regenerator thereof. The working gas cooled in this way is supplied to the low-temperature stage. Therefore, it is expected that the temperature of the working gas which is introduced from the compressor 36 to the high-temperature stage of the cryocooler 16 does not significantly affect the cooling capacity of the low-temperature stage.

The cryopump 10 shown in the drawing is a so-called horizontal cryopump. The horizontal cryopump is generally a cryopump in which the cryocooler 16 is disposed so as to intersect (usually, be orthogonal to) the axial direction of the cryopump 10.

The second stage cryopanel 19 is provided ata central portion of the internal space 14 of the cryopump 10. The second state cryopanel 19 includes, for example, a plurality of panel member 26. Each of the panel members 26 has, for example, the shape of the side surface of a truncated cone, so to speak, an umbrella-like shape. An adsorbent (not shown) such as activated carbon is usually provided at each panel member 26. The adsorbent is bonded to, for example, the back surface of the panel member 26. In this way, the second stage cryopanel 19 is provided with an adsorption region for adsorbing gas molecules.

The panel member 26 is mounted on a panel mounting member 28. The panel mounting member 28 is mounted on the second cooling stage 21. In this way, the second stage cryopanel 19 is thermally connected to the second cooling stage 21. Accordingly, the second stage cryopanel 19 is cooled to the second temperature level.

The first stage cryopanel 18 is provided with a radiation shield 30 and an inlet cryopanel 32. The first stage cryopanel 18 is provided outside of the second stage cryopanel 19 so as to surround the second stage cryopanel 19. The first stage cryopanel 18 is thermally connected to the first cooling stage 20, and the first stage cryopanel 18 is cooled to the first temperature level.

The radiation shield 30 is provided mainly to protect the second stage cryopanel 19 from radiation heat from a housing 38 of the cryopump 10. The radiation shield 30 is located between the housing 38 and the second stage cryopanel 19 and surrounds the second stage cryopanel 19. The radiation shield 30 is open toward the intake port 12 at an upper end thereof in the axial direction. The radiation shield 30 has a tubular shape (for example, a cylindrical shape) in which a lower end in the axial direction is closed, and is formed in the form of a cup. A hole for mounting of the cryocooler 16 is formed in the side surface of the radiation shield 30, and the second cooling stage 21 is inserted into the radiation shield 30 through the hole. The first cooling stage 20 is fixed to the outer surface of the radiation shield 30 at an outer peripheral portion of the mounting hole. In this way, the radiation shield 30 is thermally connected to the first cooling stage 20.

The inlet cryopanel 32 is provided above the second stage cryopanel 19 in the axial direction and disposed along the radial direction in the intake port 12. The inlet cryopanel 32 is fixed to an opening end of the radiation shield 30 at an outer peripheral portion thereof and thermally connected to the radiation shield 30. The inlet cryopanel 32 is formed in a louver structure or a chevron structure, for example. The inlet cryopanel 32 may be formed in the form of a concentric circle centered on the central axis of the radiation shield 30 or may be formed in other shapes such as a lattice shape.

The inlet cryopanel 32 is provided in order to exhaust gas entering the intake port 12. Gas (for example, moisture) which is condensed at the temperature of the inlet cryopanel 32 is captured on the surface of the inlet cryopanel 32. Further, the inlet cryopanel 32 is provided in order to protect the second stage cryopanel 19 from radiant heat from a heat source outside of the cryopump 10 (for example, a heat source in the vacuum chamber in which the cryopump 10 is mounted). The entry of not only the radiant heat but also gas molecules is restricted. The inlet cryopanel 32 occupies a part of the opening area of the intake port 12 so as to limit the inflow of gas into the internal space 14 through the intake port 12 to a desired amount.

The cryopump 10 is provided with the housing 38. The housing 38 is a vacuum container for separating the inside of the cryopump 10 from the outside. The housing 38 is configured so as to maintain the pressure in the internal space 14 of the cryopump 10 in an airtight manner. The first stage cryopanel 18 and the cryocooler 16 are accommodated in the housing 38. The housing 38 is provided outside the first stage cryopanel 18 and surrounds the first stage cryopanel 18. Further, the housing 38 accommodates the cryocooler 16. That is, the housing 38 is a cryopump container surrounding the first stage cryopanel 18 and the second stage cryopanel 19.

The housing 38 is fixed to the room-temperature part (for example, the drive mechanism 17) of the cryocooler 16 so as to be in non-contact with the first stage cryopanel 18 and the low-temperature part of the cryocooler 16. The outer surface of the housing 38 is exposed to an external environment and has a higher temperature (for example, about room temperature) than the cooled first stage cryopanel 18.

Further, the housing 38 is provided with an intake port flange 56 extending outward in the radial direction from the opening end thereof. The intake port flange 56 is a flange for mounting the cryopump 10 in the vacuum chamber that is a mounting place. A gate valve (not shown) is provided in an opening of the vacuum chamber, and the intake port flange 56 is mounted on the gate valve. In this way, the gate valve is located above the inlet cryopanel 32 in the axial direction. For example, when regenerating the cryopump 10, the gate valve is closed, and when the cryopump 10 exhausts the vacuum chamber, the gate valve is opened.

The cryopump 10 is provided with a first temperature sensor 90 for measuring the temperature of the first cooling stage 20, and a second temperature sensor 92 for measuring the temperature of the second cooling stage 21. The first temperature sensor 90 is mounted on the first cooling stage 20. The second temperature sensor 92 is mounted on the second cooling stage 21. The first temperature sensor 90 may be mounted on the first stage cryopanel 18. The second temperature sensor 92 may be mounted on the second stage cryopanel 19.

Further, the cryopump 10 is provided with a cryopump controller (hereinafter also referred to as a controller) 100. The controller 100 may be provided integrally with the cryopump 10 or may be configured as a controller separate from the cryopump 10.

The controller 100 is configured so as to control the cryocooler 16 for an vacuum pumping operation, a regeneration operation, and a cool-down operation of the cryopump 10. The controller 100 is configured so as to receive the measurement results of various sensors which include the first temperature sensor 90 and the second temperature sensor 92. The controller 100 calculates a control command to be provided to the cryocooler 16, based on the measurement results.

The controller 100 controls the cryocooler 16 such that a stage temperature follows a target cooling temperature. A target temperature of the first cooling stage 20 is normally set to a constant value. The target temperature of the first cooling stage 20 is determined, for example, as a specification according to a process which is performed in the vacuum chamber in which the cryopump 10 is mounted. The target temperature may be changed as necessary during the operation of the cryopump.

For example, the controller 100 controls an operation frequency of the cryocooler 16 by feedback control so as to minimize the deviation between the target temperature of the first cooling stage 20 and the measured temperature of the first temperature sensor 90. That is, the controller 100 controls a frequency of the thermal cycle in the cryocooler 16 by controlling a motor rotation speed of the drive mechanism 17.

When a thermal load on the cryopump 10 increases, the temperature of the first cooling stage 20 may increase. In a case where the measured temperature of the first temperature sensor 90 is higher than the target temperature, the controller 100 increases the operation frequency of the cryocooler 16. As a result, the frequency of the thermal cycle in the cryocooler 16 is also increased, and thus the first cooling stage 20 is cooled toward the target temperature. Conversely, in a case where the measured temperature of the first temperature sensor 90 is lower than the target temperature, the operation frequency of the cryocooler 16 is decreased, and thus the temperature of the first cooling stage 20 rises toward the target temperature. In this way, the temperature of the first cooling stage 20 can be maintained in a temperature range in the vicinity of the target temperature. The operation frequency of the cryocooler 16 can be appropriately adjusted according to the thermal load, and therefore, such control is helpful to a reduction in the power consumption of the cryopump 10.

Controlling the cryocooler 16 such that the temperature of the first cooling stage 20 follows the target temperature is hereinafter often referred to as "first stage temperature control". When the cryopump 10 is performing the vacuum pumping operation, normally, the first stage temperature control is executed. As a result of the first stage temperature control, the second cooling stage 21 and the second stage cryopanel 19 are cooled to a temperature which is determined according to the specifications of the cryocooler 16 and a thermal load from the outside. Similarly, the controller 100 can also execute, so to speak, "second stage temperature control" to control the cryocooler 16 such that the temperature of the second cooling stage 21 follows the target temperature.

Figures 2, 3:
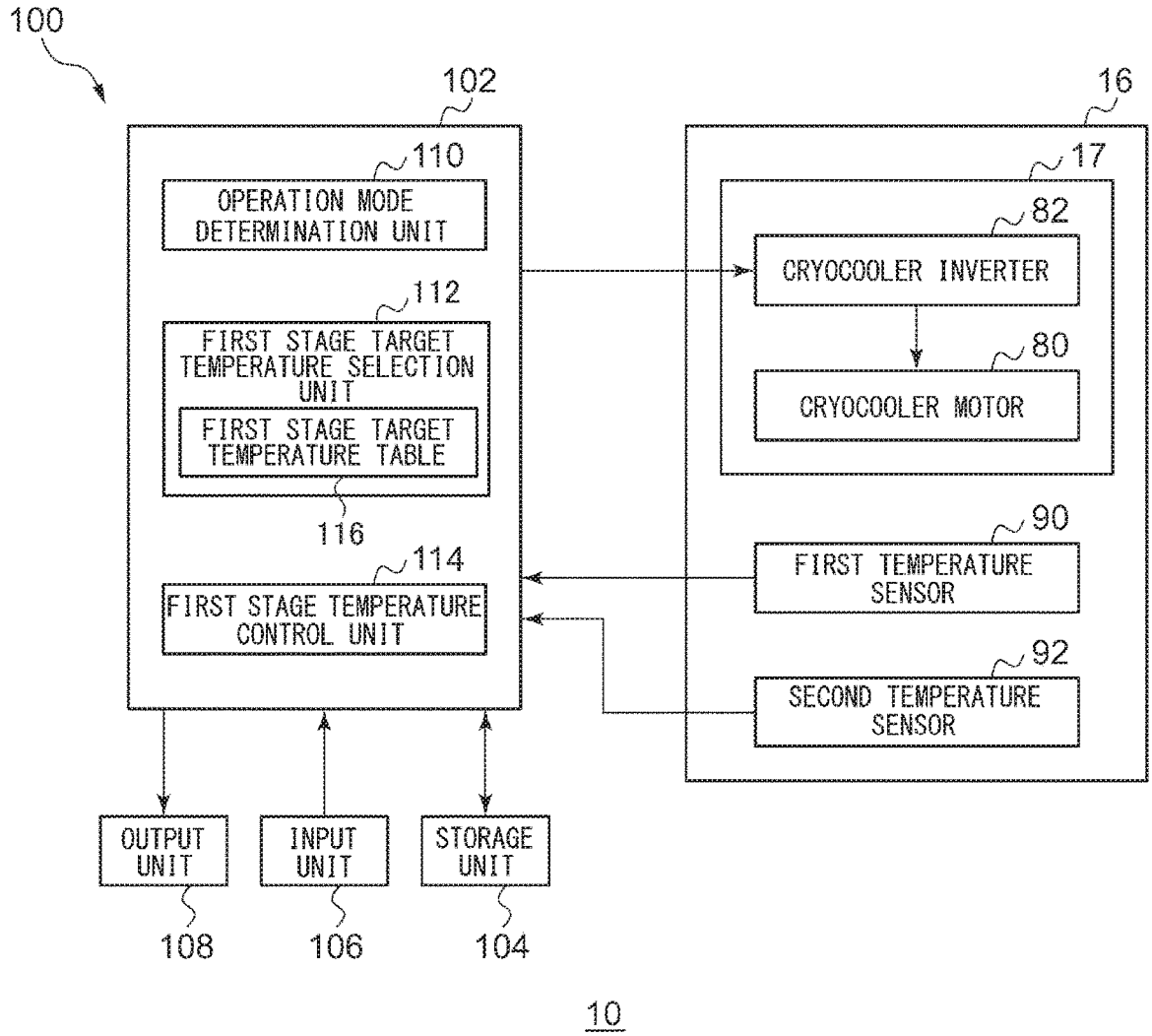
FIG. 2 schematically shows the configuration of a cryopump controller according to an embodiment.
FIG. 3 shows a first stage target temperature table according to an embodiment.

FIG. 2 is a diagram schematically showing the configuration of the controller 100 of the cryopump 10 according to an embodiment. Such a controller is realized by hardware, software, or a combination of these. Further, in FIG. 2, the configuration of a part of the relevant cryocooler 16 is schematically shown.

The drive mechanism 17 of the cryocooler 16 is provided with a cryocooler motor 80 for driving the cryocooler 16, and a cryocooler inverter 82 for controlling the operation frequency of the cryocooler 16. As described above, the cryocooler 16 is a working gas expander, and therefore, the cryocooler motor 80 and the cryocooler inverter 82 can also be respectively referred to as an expander motor and an expander inverter.

The operation frequency (also referred to as an operation speed) of the cryocooler 16 represents an operation frequency or a rotation speed of the cryocooler motor 80, an operation frequency of the cryocooler inverter 82, the frequency of the thermal cycle, or any one of them. The frequency of the thermal cycle is the number of times per unit time, of the thermal cycles which are performed in the cryocooler 16.

The controller 100 is provided with a cryocooler control unit 102, a storage unit 104, an input unit 106, and an output unit 108. The cryocooler control unit 102 is configured so as to control the cryocooler 16 in order to execute the vacuum pumping operation and the regeneration operation of the cryopump 10. The cryocooler control unit 102 is configured so as to control the cryocooler 16 in order to execute a cool-down operation of lowering the temperature of at least one cryopanel (the first stage cryopanel 18 and/or the second stage cryopanel 19, and the same applies to the following) from room temperature to a standard operation temperature. The cryocooler control unit 102 is configured so as to control the cryocooler 16 such that a temperature control operation of maintaining the temperature of at least one cryopanel at the standard operation temperature is executed following the cool-down operation.

The storage unit 104 is configured so as to store data related to the control of the cryopump 10. The input unit 106 is configured so as to receive input from a user or another device. The input unit 106 includes, for example, input means such as a mouse or a keyboard for receiving input from a user, and/or communication means for communicating with another device. The output unit 108 is configured so as to output data related to the control of the cryopump 10 and includes output means such as a display or a printer.

Each of the storage unit 104, the input unit 106, and the output unit 108 is communicably connected to the cryocooler control unit 102. Accordingly, the cryocooler control unit 102 can read data from the storage unit 104 and/or store data in the storage unit 104, as necessary. Further, the cryocooler control unit 102 can receive data input from the input unit 106 and/or output data to the output unit 108.

The cryocooler control unit 102 is provided with an operation mode determination unit 110, a first stage target temperature selection unit 112, and a first stage temperature control unit 114.

The operation mode determination unit 110 is configured so as to determine the operation mode of the cryopump 10. The operation mode determination unit 110 is configured so as to determine whether or not to switch from a certain operation mode to another operation mode, based on the current state of the cryopump 10. The operation mode determination unit 110 switches the operation mode in a case where such a mode switching condition is satisfied. The operation mode determination unit 110 continues the current operation mode in a case where the mode switching condition is not satisfied.

A plurality of operation modes are set in advance in the cryopump 10. The operation mode includes, for example, a cool-down mode of cooling each of the first stage cryopanel and the second stage cryopanel from room temperature to an extremely low temperature region, and a normal mode of maintaining each of the first stage cryopanel and the second stage cryopanel at the extremely low temperature region. The operation mode determination unit 110 is configured so as to determine whether or not to switch from the cool-down mode to the normal mode, based on the measured second stage cryopanel temperature.

The operation mode determination unit 110 may be configured so as to determine the operation mode of the cryopump 10. An operation mode flag corresponding to each of a plurality of different operation modes may be determined in advance. The storage unit 104 may store these operation mode flags. The operation mode determination unit 110 may be configured so as to select, when the cryopump 10 enters a certain operation mode, the operation mode flag corresponding to the operation mode. The operation mode determination unit 110 may determine the current operation mode of the cryopump 10 with reference to the selected operation mode flag.

The first stage target temperature selection unit 112 is provided with a first stage target temperature table 116. The first stage target temperature selection unit 112 is configured so as to select the first stage target temperature according to the current operation mode with reference to the first stage target temperature table 116. The first stage target temperature table 116 is stored in advance in the storage unit 104 and may be read to the first stage target temperature selection unit 112, as necessary.

The first stage temperature control unit 114 is configured so as to control the first stage cryopanel temperature according to the selected first stage target temperature. The first stage temperature control unit 114 is configured so as to determine the operation frequency of the cryocooler motor 80 (for example, by PID control) as a function of the deviation between the measured temperature of the cryopanel and the target temperature, as described above. The first stage temperature control unit 114 determines the operation frequency of the cryocooler motor 80 within an operation frequency range determined in advance. The operation frequency range is defined by the upper limit and the lower limit of an operation frequency determined in advance. The first stage temperature control unit 114 outputs the determined operation frequency to the cryocooler inverter 82.

The first stage temperature control unit 114 may control a heater attached to the cryocooler 16 together with the operation frequency of the cryocooler motor 80 (or instead of the operation frequency of the cryocooler motor 80).

The cryocooler inverter 82 is configured so as to provide variable frequency control of the cryocooler motor 80. The cryocooler inverter 82 converts input power so as to have the operation frequency input from the first stage temperature control unit 114. The input power to the cryocooler inverter 82 is supplied from a cryocooler power supply (not shown). The cryocooler inverter 82 outputs the converted power to the cryocooler motor 80. In this way, the cryocooler motor 80 is driven with the operation frequency determined by the first stage temperature control unit 114 and output from the cryocooler inverter 82.

FIG. 3 shows the first stage target temperature table 116 according to an embodiment. The first stage target temperature table 116 is configured so as to correlate the cryopump operation mode with the first stage target temperature. As shown in the drawing, a normal target temperature T1*c*1 for the normal mode and a cool-down target temperature T1*c*2 for the cool-down mode are set in advance in the first stage target temperature table 116. In this example, the normal target temperature T1*c*1 is 80 K and the cool-down target temperature T1*c*2 is 70 K.

The cool-down target temperature T1*c*2 is lower than the normal target temperature T1*c*1. The normal target temperature T1*c*1 is a first predetermined temperature which is selected from, for example, the range from 80 K to 130 K. The cool-down target temperature T1*c*2 is a second predetermined temperature which is selected from, for example, the range from 60K to the first predetermined temperature. The cool-down target temperature T1*c*2 may be selected from the range from 65 K to the first predetermined temperature. In this temperature region, undesirable condensation of residual gas in the housing 38 to the first stage cryopanel 18 is prevented. Further, the temperature difference between the cool-down target temperature T1*c*2 and the normal target temperature T1*c*1 is relatively small, and therefore, at the time of switching from the cool-down mode to the normal mode, it is easy to raise the temperature of the first stage cryopanel 18 from the cool-down target temperature T1*c*2 to the normal target temperature T1*c*1. The normal target temperature T1*c*1 and the cool-down target temperature T1*c*2 are experimentally or empirically determined in advance.

In this way, the first stage target temperature selection unit 112 is provided with the normal target temperature T1*c*1 and the cool-down target temperature T1*c*2. The first stage target temperature selection unit 112 is configured so as to select the normal target temperature T1*c*1 as the first stage target temperature in a case where the current operation mode is the normal mode, and at least temporarily select the cool-down target temperature T1*c*2 as the first stage target temperature in a case where the current operation mode is the cool-down mode.

Figure 4:
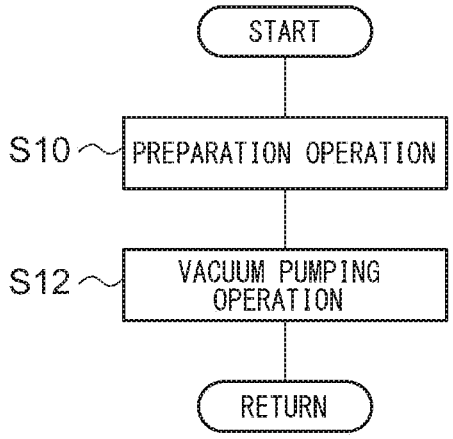
FIG. 4 is a flowchart for explaining an operation method of the cryopump.

FIG. 4 is a flowchart for explaining an operation method of the cryopump 10. The operation method includes a preparation operation (S10) and a vacuum pumping operation (S12). The above-described normal mode corresponds to the vacuum pumping operation. The preparation operation includes an arbitrary operation mode which is executed prior to the normal mode. The controller 100 repeatedly executes this operation method in a timely manner. When the vacuum pumping operation is ended and the preparation operation is started, usually, the gate valve between the cryopump 10 and the vacuum chamber is closed.

The preparation operation (S10) is, for example, start-up of the cryopump 10. The start-up of the cryopump 10 includes cool-down to cool the cryopanel from the temperature (for example, room temperature) of the environment in which the cryopump 10 is installed to an extremely low temperature. The target cooling temperature of the cool-down is a standard operation temperature which is set for the vacuum pumping operation. The standard operation temperature is selected from, for example, a range of about 80 K to 100 K with respect to the first stage cryopanel 18, and from, for example, a range of about 10 K to 20 K with respect to the second stage cryopanel 19, as described above. The preparation operation (S10) may include roughing the pressure in the inside of the cryopump 10 to an operation starting pressure (for example, about 1 Pa) by using a roughing valve (not shown) or the like.

The preparation operation (S10) may be the regeneration of the cryopump 10. The regeneration is executed for the preparation of the next vacuum pumping operation after the ending of the current vacuum pumping operation. The regeneration is so-called full regeneration of regenerating the second stage cryopanel 19 and the first stage cryopanel 18, or partial regeneration of regenerating only the second stage cryopanel 19.

The regeneration includes a temperature raising step, a discharge step, and a cooling step. The temperature raising step includes raising the temperature of the cryopump 10 to a regeneration temperature which is higher than the above-described standard operation temperature. In the case of the full regeneration, the regeneration temperature is, for example, room temperature or a temperature (for example, a range of about 290 K to about 300 K) somewhat higher than the room temperature. A heat source for the temperature raising step is, for example, a reverse temperature rise of the cryocooler 16 and/or a heater which is attached to the cryocooler 16.

The discharge step includes discharging gas re-vaporized from the surface of the cryopanel to the outside of the cryopump 10. The re-vaporized gas is discharged from the cryopump 10 together with purge gas which is introduced as necessary. In the discharge step, the operation of the cryocooler 16 is stopped. The cooling step includes re-cooling the second stage cryopanel 19 and the first stage cryopanel 18 in order to restart the vacuum pumping operation. The operation mode of the cryocooler 16 in the cooling step is the same as the cool-down for start-up. However, the initial temperature of the cryopanel in the cooling step is in a room temperature level in the case of the full regeneration. However, in the case of the partial regeneration, the initial temperature is in the middle (for example, a range of 100 K to 200 K) between room temperature and the above-described standard operation temperature.

As shown in FIG. 4, the vacuum pumping operation (S12) is executed following the preparation operation (S10). When the preparation operation is ended and the vacuum pumping operation is started, the gate valve between the cryopump 10 and the vacuum chamber is opened.

The inlet cryopanel 32 cools gas flying toward the cryopump 10 from the vacuum chamber. Gas having vapor pressure (of, for example, $10^{-8}$ Pa or less) which is sufficiently low at a first cooling temperature is condensed on the surface of the inlet cryopanel 32. This gas may be referred to as type 1 gas. The type 1 gas is, for example, water vapor. In this way, the inlet cryopanel 32 can exhaust the type 1 gas. Some of gas having vapor pressure which is not sufficiently low at the first cooling temperature enter the internal space 14 from the intake port 12. Alternatively, some other gas is reflected by the inlet cryopanel 32 and does not enter the internal space 14.

The gas having entered the internal space 14 is cooled by the second stage cryopanel 19. Gas having vapor pressure (of, for example, $10^{-8}$ Pa or less) which is sufficiently low at a second cooling temperature is condensed on the surface of the second stage cryopanel 19. This gas may be referred to as type 2 gas. The type 2 gas is, for example, argon. In this way, the second stage cryopanel 19 can exhaust the type 2 gas.

Gas having vapor pressure which is not sufficiently low at the second cooling temperature is adsorbed to the adsorbent of the second stage cryopanel 19. This gas may be referred to as type 3 gas. The type 3 gas is, for example, hydrogen. In this way, the second stage cryopanel 19 can exhaust the type 3 gas. Therefore, the cryopump 10 can exhaust various gases by condensation or adsorption to make the degree of vacuum of the vacuum chamber reach a desired level.

Figure 5:
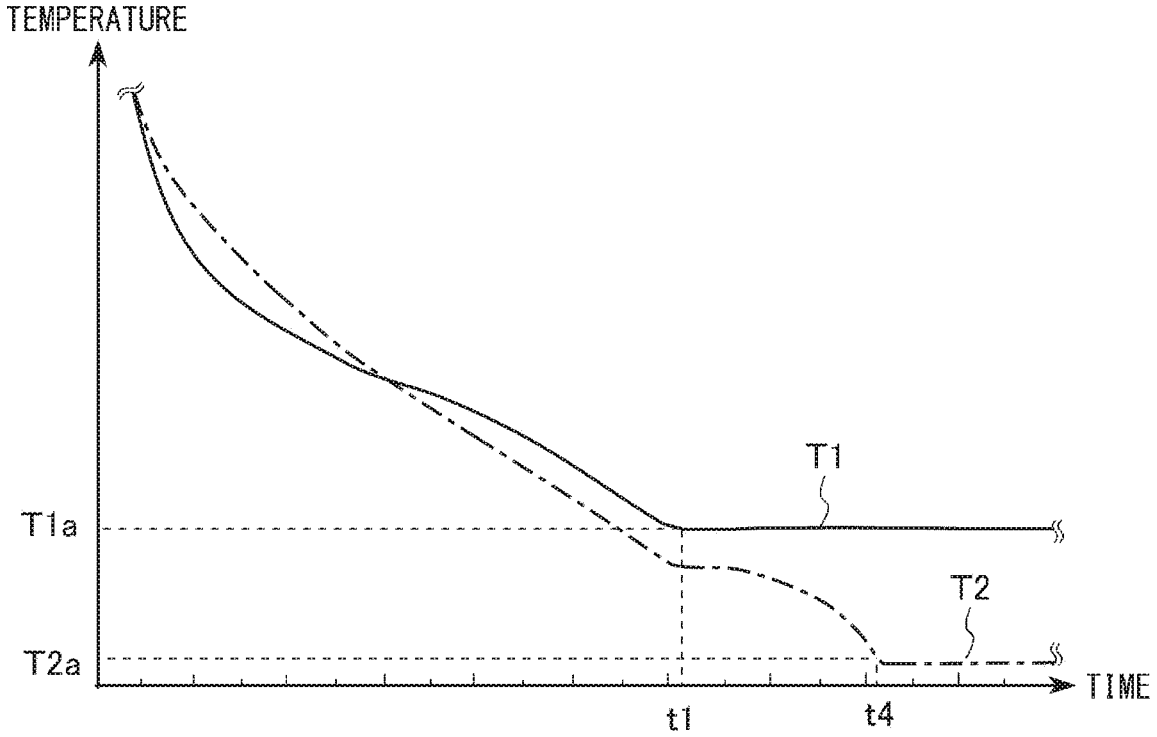
FIG. 5 illustrates a temperature profile in a typical cool-down operation.

FIG. 5 is a diagram showing an example of a temperature profile in a typical cool-down mode. The vertical axis and the horizontal axis of FIG. 5 respectively represent temperature and time. In FIG. 5, time changes of a first stage cryopanel temperature T1 and a second stage cryopanel temperature T2 are shown schematically. The initial values of both the first stage cryopanel temperature T1 and the second stage cryopanel temperature T2 when starting the cool-down are, for example, 300 K. A first stage target temperature T1*a* is, for example, 80 K and a second stage target temperature T2*a* is, for example, 10 K.

After the start of the cool-down, as shown in the drawing, both the first stage cryopanel temperature T1 and the second stage cryopanel temperature T2 fall. Each of the temperatures is different from the target temperature, and therefore, the cryocooler 16 is operated at a considerably high operation frequency (for example, the allowable maximum operation frequency, or the vicinity thereof), and thus, the cryopanels are rapidly cooled toward the target temperatures. In this way, the first stage cryopanel temperature T1 reaches the first stage target temperature T1*a* at a time t1. At this point in time, the second stage cryopanel temperature T2 is cooled to a temperature somewhat lower than the first stage target temperature T1*a*. However, it is still far from the second stage target temperature T2*a*.

After the time t1, the first stage cryopanel temperature T1 is maintained at the first stage target temperature T1*a*. For this reason, the cryocooler 16 is operated at a low operation frequency. The second stage cryopanel temperature T2 gently falls toward the second stage target temperature T2*a* and reaches the second stage target temperature T2*a* at a time t4. With this, the cool-down is completed and the vacuum pumping operation is started.

Figure 6:
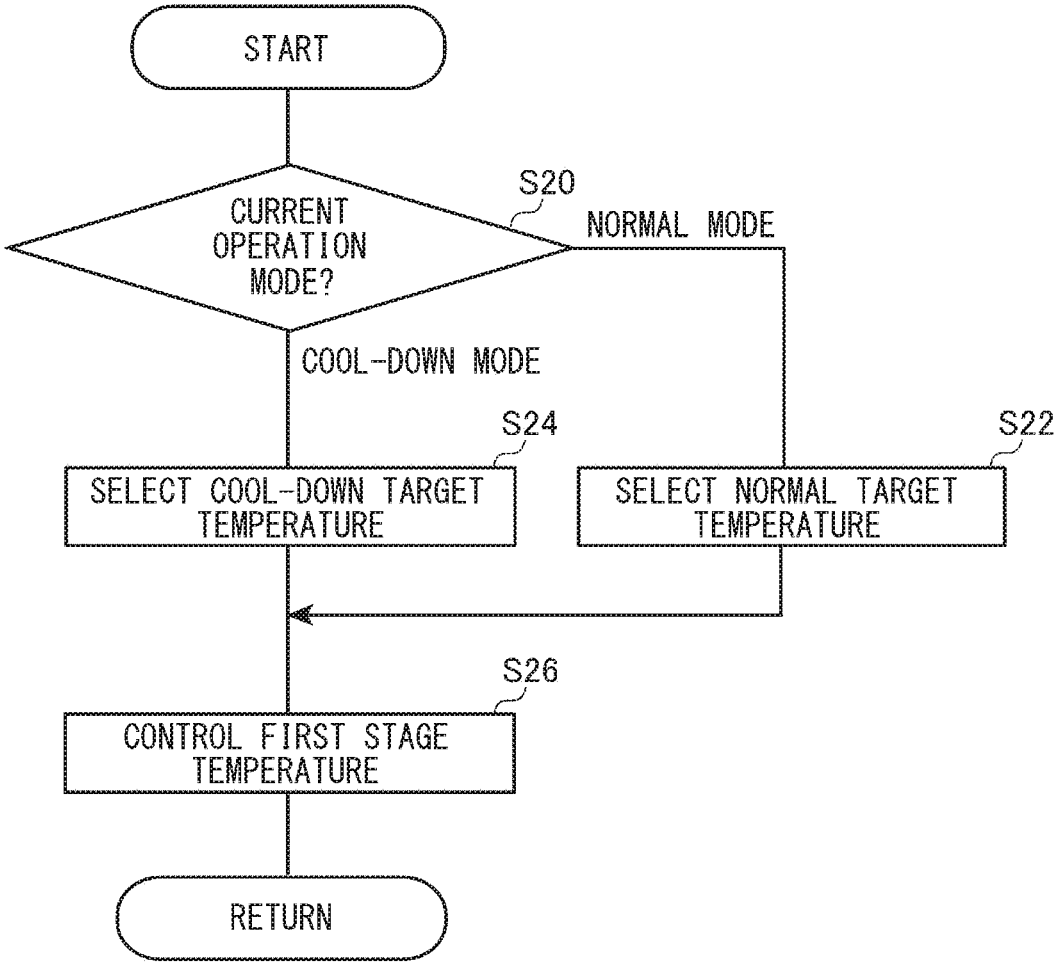
FIG. 6 is a flowchart showing a cryopump control method according to an embodiment.

FIG. 6 is a flowchart showing a method of controlling the cryopump 10 according to an embodiment. In FIG. 6, first stage target temperature switching processing is illustrated. The cryocooler control unit 102 periodically executes the first stage target temperature switching processing after the cool-down mode is started.

First, the first stage target temperature selection unit 112 selects the first stage target temperature according to the current operation mode (S20). The first stage target temperature selection unit 112 acquires the current operation mode from the operation mode determination unit 110.

The first stage target temperature selection unit 112 refers to the first stage target temperature table 116. The first stage target temperature selection unit 112 selects the normal target temperature T1*c*1 as the first stage target temperature in a case where the current operation mode is the normal mode (S22), and selects the cool-down target temperature T1*c*2 as the first stage target temperature in a case where the current operation mode is the cool-down mode (S24). The first stage target temperature selection unit 112 outputs the selected first stage target temperature to the first stage temperature control unit 114.

The first stage temperature control unit 114 controls the first stage cryopanel temperature according to the selected first stage target temperature (S26). The first stage temperature control unit 114 executes the above-described first stage temperature control. In this way, the processing shown in FIG. 6 is ended.

Figure 7:
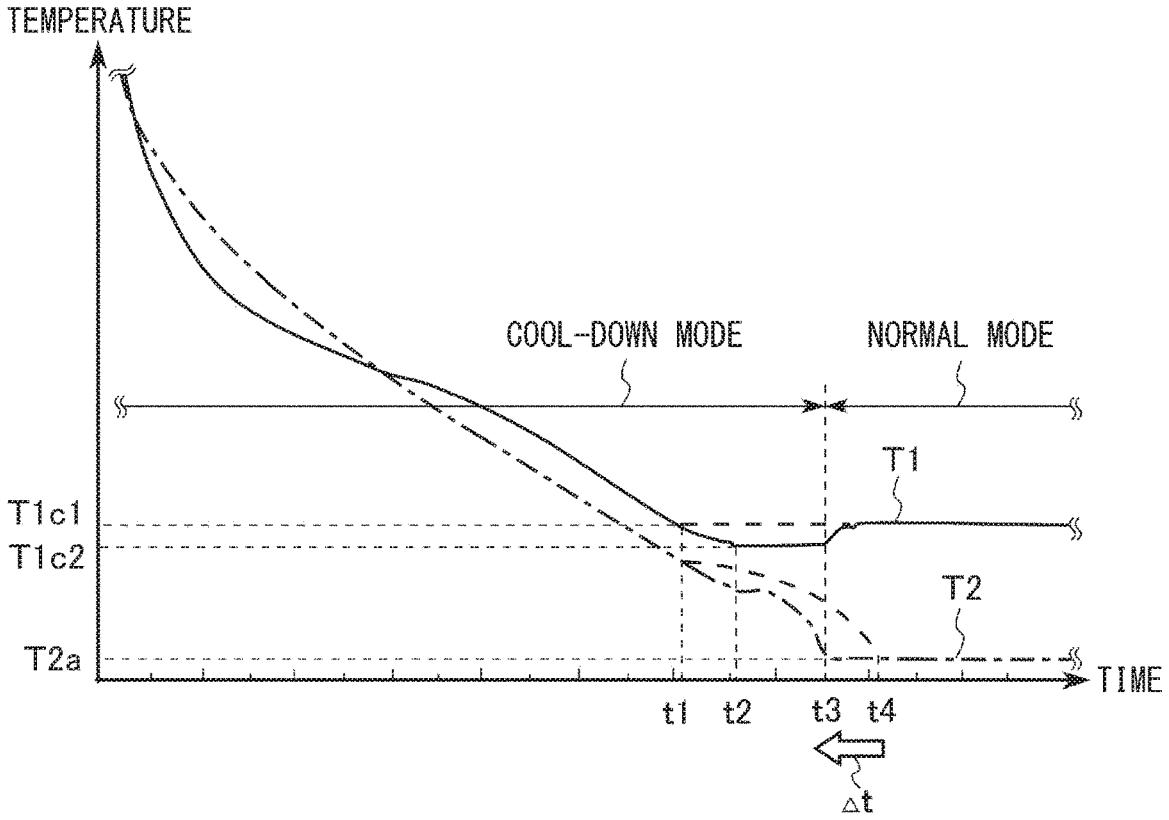
FIG. 7 illustrates a temperature profile in a cool-down operation according to an embodiment.

FIG. 7 is a diagram showing an example of a temperature profile in the cool-down mode according to an embodiment. Similar to FIG. 5, the vertical axis and the horizontal axis of FIG. 7 respectively represent temperature and time. In FIG. 7, for comparison, the temperature profile shown in FIG. 5 is indicated by a broken line.

Similar to the case shown in FIG. 5, the initial values of both the first stage cryopanel temperature T1 and the second stage cryopanel temperature T2 are, for example, 300 K. When starting the cool-down, the cool-down target temperature T1*c*2 is set as the first stage target temperature. The cool-down target temperature T1*c*2 is, for example, 70 K. The second stage target temperature T2*a* is, for example, 10 K.

After the start of the cool-down, both the first stage cryopanel temperature T1 and the second stage cryopanel temperature T2 fall. The first stage cryopanel temperature T1 reaches the cool-down target temperature T1*c*2 at a time t2. The cool-down target temperature T1*c*2 is lower than the first stage target temperature T1*a* in FIG. 5, and therefore, the time t2 is later than the time t1. At this point in time, the second stage cryopanel temperature T2 has not yet reached the second stage target temperature T2*a*.

After the time t2, the first stage cryopanel temperature T1 is maintained at the cool-down target temperature T1*c*2. The second stage cryopanel temperature T2 falls toward the second stage target temperature T2*a* and reaches the second stage target temperature T2*a* at a time t3, With this, the mode is switched from the cool-down mode to the normal mode, and the vacuum pumping operation is started. The first stage target temperature is changed to the normal target temperature T1*c*1 and the first stage cryopanel temperature T1 follows it.

It is important that the time t3 is earlier than the time t4. That is, in the case of FIG. 7, the required time for the cool-down is shortened by Δt(=t4−t3), compared to FIG. 5. This is because the operation frequency of the cryocooler 16 becomes higher such that the first stage cryopanel temperature T1 is maintained at a lower temperature, compared to the case of FIG. 5. In this way, according to this embodiment, it is possible to shorten the cooling time of the cryopump 10.

Figures 8, 9:
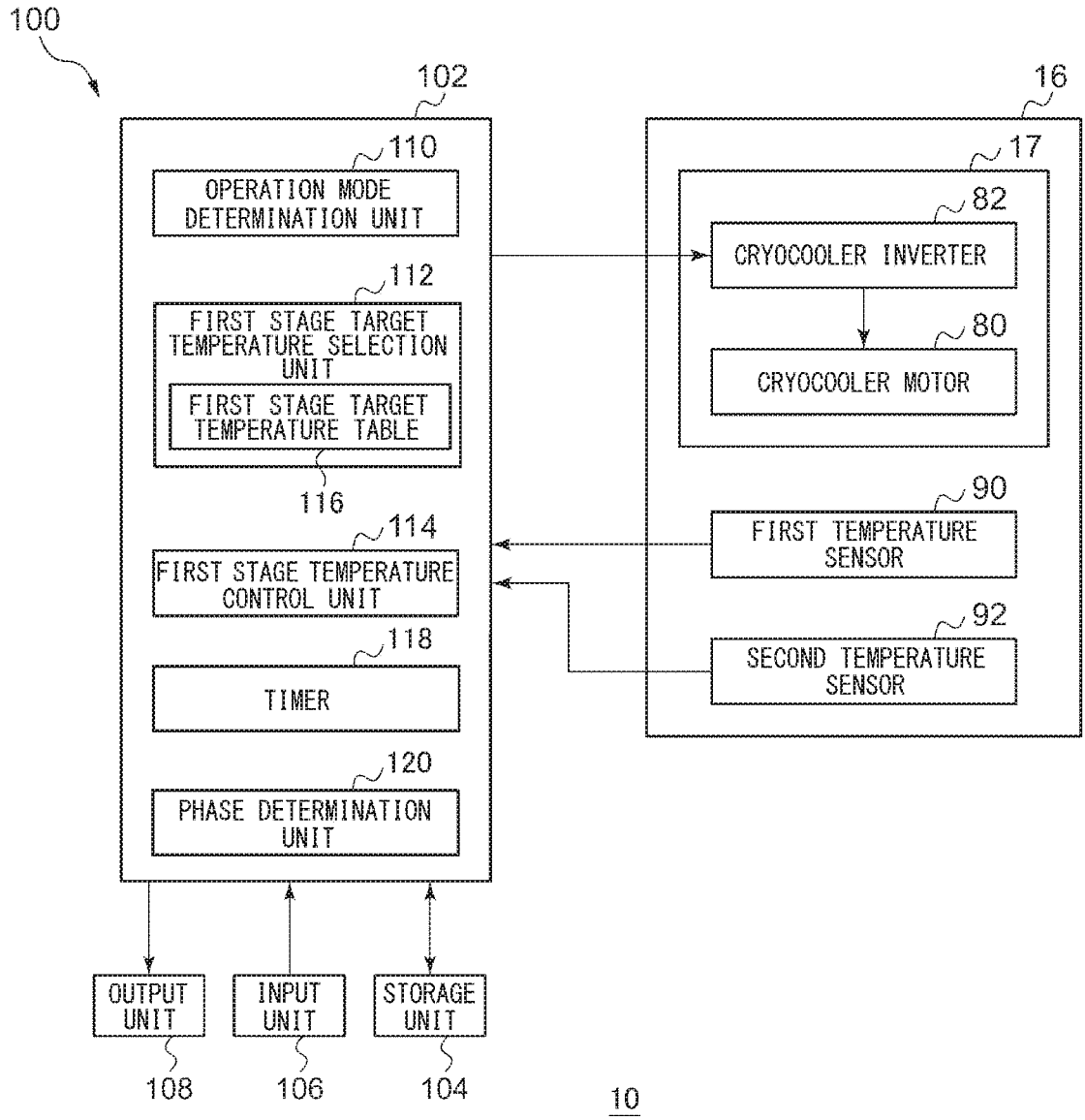
FIG. 8 schematically shows the configuration of a cryopump controller according to another embodiment.
FIG. 9 shows a first stage target temperature table according to another embodiment.

FIG. 8 is a diagram schematically showing the configuration of the controller 100 of the cryopump 10 according to another embodiment. The cryocooler control unit 102 includes a timer 118 and a phase determination unit 120, in addition to the operation mode determination unit 110, the first stage target temperature selection unit 112, and the first stage temperature control unit 114. The timer 118 is configured so as to measure an elapsed time from the start of the cool-down mode. The phase determination unit 120 is configured so as to determine a current phase in the cool-down mode, based on the current state of the cryopump 10.

The phase determination unit 120 is configured so as to monitor the current state of the cryopump 10. The phase determination unit 120 monitors, for example, the elapsed time from the start of the cool-down mode. The phase determination unit 120 refers to the timer 118. The phase determination unit 120 is configured so as to determine the current phase as a first phase in a case where the elapsed time measured by the timer 118 is shorter than a threshold time, and determine the current phase as a second phase in a case where the elapsed time is longer than the threshold time. It can also be said that the first phase represents the first half or the initial stage of the cool-down mode and the second phase represents the second half or the final stage of the cool-down mode. The threshold time may be experimentally or empirically determined in advance and stored in the storage unit 104.

Alternatively, the phase determination unit 120 may monitor the second stage cryopanel temperature. The phase determination unit 120 may determine the current phase as the first phase in a case where the second stage cryopanel temperature is higher than a threshold temperature, and determine the current phase as the second phase in a case where the second stage cryopanel temperature is lower than the threshold temperature. The threshold temperature may be selected from the range from the second stage target temperature to 60 K. The threshold temperature may be experimentally or empirically determined in advance and stored in the storage unit 104.

FIG. 9 shows the first stage target temperature table 116 according to another embodiment. The first stage target temperature table 116 has a plurality of cool-down target temperatures. For example, a first target temperature T1*c*21 for the first phase and a second target temperature T1*c*22 for the second phase are set in advance in the first stage target temperature table 116. Similar to the embodiment described above, the first stage target temperature table 116 has the normal target temperature T1*c*1. The first target temperature T1*c*21 is lower than the normal target temperature T1*c*1, and the second target temperature T1*c*22 is higher than first target temperature T1*c*21 and lower than the normal target temperature T1*c*1. In this example, the first target temperature T1*c*21 is 60 K and the second target temperature T1*c*22 is 70 K.

Figure 10:
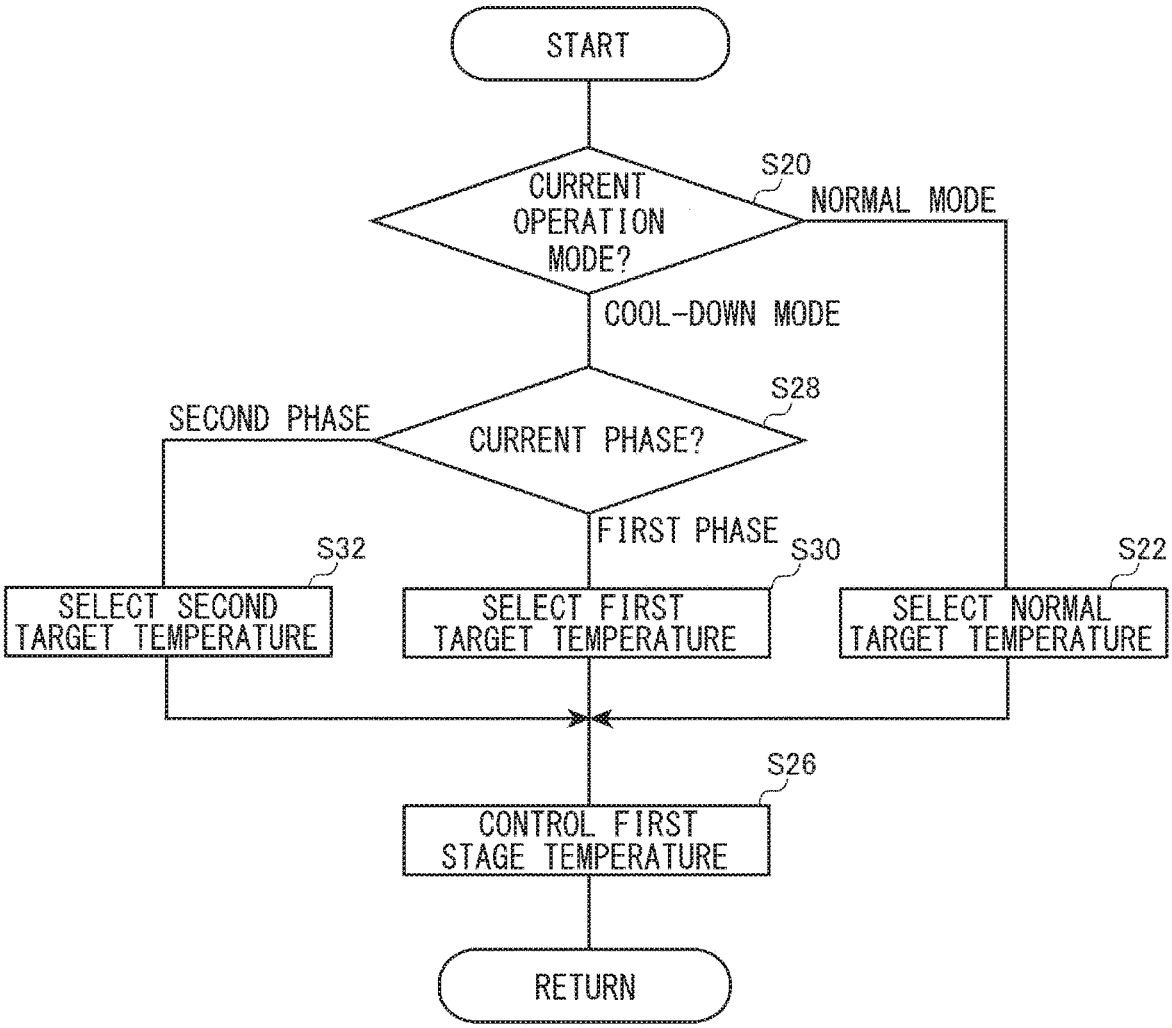
FIG. 10 is a flowchart showing a cryopump control method according to another embodiment.

FIG. 10 is a flowchart showing a method of controlling the cryopump 10 according to another embodiment. Similar to the first stage target temperature switching processing illustrated in FIG. 6, the first stage target temperature selection unit 112 selects the first stage target temperature according to the current operation mode (S20). The first stage target temperature selection unit 112 selects the normal target temperature T1*c*1 as the first stage target temperature in a case where the current operation mode is the normal mode (S22).

The first stage target temperature selection unit 112 selects the first stage target temperature according to the current phase determined by the phase determination unit 120, in a case where the current operation mode is the cool-down mode (S28). The first stage target temperature selection unit 112 selects the first target temperature T1*c*21 as the first stage target temperature in a case where the current phase is the first phase (S30), and selects the second target temperature T1*c*22 as the first stage target temperature in a case where the current phase is the second phase (S32). The first stage target temperature selection unit 112 outputs the selected first stage target temperature to the first stage temperature control unit 114. The first stage temperature control unit 114 controls the first stage cryopanel temperature according to the selected first stage target temperature (S26). In this way, the processing shown in FIG. 10 is ended.

Even in this way, it is possible to shorten the cooling time of the cryopump 10.

The present invention has been described above based on the embodiments. It should be understood that the invention is not limited to the above-described embodiments, but may be modified into various forms on the basis of the spirit of the invention. Additionally, the modifications are included in the scope of the invention.

In an embodiment, the first stage target temperature selection unit 112 may be configured so as to select the cool-down target temperature as the first stage target temperature for a temporary period of time (for example, at the initial stage of the cool-down mode) in a case where the current operation mode is the cool-down mode. For example, the first stage target temperature selection unit 112 may select the cool-down target temperature T1*c*2 (for example, the first target temperature T1*c*21) as the first stage target temperature in a case where the current phase is the first phase, and select the normal target temperature T1*c*1 as the first stage target temperature in a case where the current phase is the second phase.

The cryocooler 16 may be a three-stage type cryocooler in which cylinders of three stages are connected in series, or a multi-stage cryocooler having more stages than it. The cryocooler 16 may be a cryocooler other than the GM cryocooler, and a pulse tube cryocooler or a Solvay cryocooler may be used.

In the above description, the horizontal cryopump has been illustrated. However, the present invention is also applicable to other vertical cryopumps. The vertical cryopump refers to a cryopump in which the cryocooler 16 is disposed along the axial direction of the cryopump 10.

What is claimed is:

1. A cryopump comprising:

a first stage cryopanel configured to be cooled to a first-stage cryopanel temperature;

a second stage cryopanel configured to be cooled to a second-stage cryopanel temperature, the second-stage cryopanel temperature being lower than the first-stage cryopanel temperature;

a data storage configured to store a first-stage target-temperature table, the first-stage target-temperature table comprising:

a normal target temperature for a normal mode of maintaining the first stage cryopanel within a cryogenic temperature region, and a cool-down target temperature for a cool-down mode of cooling the first stage cryopanel from room temperature to the cryogenic temperature region, the cool-down target temperature being lower than the normal target temperature;

a cryocooler controller communicably connected to the data storage, the cryocooler controller is configured to:

select, as a current operation mode, one of the normal mode and the cool-down mode, select, in accordance with the first-stage target temperature table and the selected current operation mode, one of the normal target temperature and the cool-down target temperature as a first-stage target temperature, control, according to the selected first-stage target temperature, the first-stage cryopanel temperature, and switch, when the second-stage cryopanel temperature reaches a second target temperature during the cool-down mode, the current operation mode from the cool-down mode to the normal mode and change the first-stage target temperature from the cool-down target temperature to the normal target temperature to control the first-stage cryopanel temperature to the normal target temperature.

2. The cryopump according to claim 1, wherein the normal target temperature is a predetermined temperature which is selected from a range from 80 K to 130 K, and the cool-down target temperature is selected from a range from 60 K to the predetermined temperature.

3. A cryopump comprising:

a first stage cryopanel configured to be cooled to a first-stage cryopanel temperature;

a second stage cryopanel configured to be cooled to a second-stage cryopanel temperature, the second-stage cryopanel temperature being lower than the first-stage cryopanel temperature;

a data storage configured to store a first-stage target-temperature table, the first-stage target-temperature table comprising:

a normal target temperature for a normal mode of maintaining the first stage cryopanel within a cryogenic temperature region, and a cool-down target temperature for a cool-down mode of cooling the first stage cryopanel from room temperature to the cryogenic temperature region, the cool-down target temperature being lower than the normal target temperature, and a cryocooler controller communicably connected to the data storage, the cryocooler controller is configured to:

select, as a current operation mode, one of the normal mode and the cool-down mode, select, in accordance with the first-stage target temperature table and the selected current operation mode, one of the normal target temperature and the cool-down target temperature as a first-stage target temperature, control, according to the selected first-stage target temperature, the first-stage cryopanel temperature, determine a current phase in the cool-down mode, based on at least one of an elapsed time from a start of the cool-down mode and a second stage cryopanel temperature, and select the first-stage target temperature according to the at least one of the elapsed time from the start of the cool-down mode and the second stage cryopanel temperature.

4. The cryopump according to claim 3, wherein the cryocooler controller monitors the elapsed time from a start of the cool-down mode, determines the current phase as the first phase in a case where the elapsed time is shorter than a threshold time, and determines the current phase as the second phase in a case where the elapsed time is longer than the threshold time.

5. The cryopump according to claim 3, wherein the cryocooler controller is configured to:

monitor the second stage cryopanel temperature, determine the current phase as the first phase in a case where the second stage cryopanel temperature is higher than a threshold temperature, and determine the current phase as the second phase in a case where the second stage cryopanel temperature is lower than the threshold temperature.

6. A cryopump controller comprising:

a data storage configured to store a first-stage target-temperature table, the first-stage target-temperature table comprising:

a normal target temperature for a normal mode of maintaining a first stage cryopanel within a cryogenic temperature region, and a cool-down target temperature for a cool-down mode of cooling the first stage cryopanel from room temperature to the cryogenic temperature region, the cool-down target temperature being lower than the normal target temperature; and a cryocooler controller communicably connected to the data storage, the cryocooler controller is configured to:

select, as a current operation mode, one of the normal mode and the cool-down mode, select, in accordance with the first-stage target temperature table and the selected current operation mode, one of the normal target temperature and the cool-down target temperature as a first-stage target temperature, control, according to the selected first-stage target temperature, a first-stage cryopanel temperature, and switch, when a second-stage cryopanel temperature reaches a second target temperature during the cool-down mode, the current operation mode from the cool-down mode to the normal mode and change the first-stage target temperature from the cool-down target temperature to the normal target temperature to control the first-stage cryopanel temperature to the normal target temperature.

7. A cryopump control method comprising:

selecting, by a cryocooler controller as a current operation mode one of:

a normal mode of maintaining a first stage cryopanel within a cryogenic temperature region, and a cool-down mode of cooling the first stage cryopanel from room temperature to the cryogenic temperature region, selecting, by the cryocooler controller as a first-stage target temperature one of:

a normal target temperature, and a cooldown target temperature according to the current operation mode, the cool-down target temperature being lower than the normal target temperature;

controlling, by the cryocooler controller, a first-stage cryopanel temperature according to the selected first stage target temperature; and switching, when a second-stage cryopanel temperature reaches a second target temperature during the cool-down mode, the current operation mode from the cool-down mode to the normal mode and changing the first-stage target temperature from the cool-down target temperature to the normal target temperature to control the first-stage cryopanel temperature to the normal target temperature.

* * * * *